US005526712A

United States Patent [19]

Eto

[11] Patent Number: 5,526,712

[45] Date of Patent: Jun. 18, 1996

[54] DRIVING APPARATUS FOR MOVING BODY

[75] Inventor: Tetsutaro Eto, Tokyo, Japan

[73] Assignee: Eto Denki Co., Tokyo, Japan

[21] Appl. No.: 220,091

[22] Filed: Mar. 30, 1994

[51] Int. Cl.[6] ..... G05G 11/00

[52] U.S. Cl. ..... 74/490.09; 74/490.1; 74/89.17

[58] Field of Search ..... 74/490.09, 490.1, 74/490.07, 479.01, 89.17; 108/20, 143; 248/661, 913; 33/1 M; 446/136

[56] References Cited

U.S. PATENT DOCUMENTS

| | | | |
|---|---|---|---|
| 3,241,243 | 3/1966 | Speer | 33/1 M (X) |
| 3,517,624 | 6/1970 | Helms | 108/20 X |
| 4,208,833 | 6/1980 | Wolf | 446/136 |
| 4,876,789 | 10/1989 | Burwell | 33/1 M X |
| 5,279,178 | 1/1994 | Yanagisawa | 74/490.09 |
| 5,311,791 | 5/1994 | Yanagisawa | 74/490.09 |
| 5,355,744 | 10/1994 | Yanagisawa | 74/490.09 |

FOREIGN PATENT DOCUMENTS 2-92383 4/1990 Japan .

*Primary Examiner*—Richard M. Lorence
*Attorney, Agent, or Firm*—Foley & Lardner

[57] ABSTRACT

A mechanism for moving a running member comprises a track plate 8 having a guide 12, and a running member 9 adapted to run on the track plate 8. The guide 12 includes a plurality of longitudinal racks 10 and a plurality of lateral racks 10*a* crossed at right angles. The running member 9 has a plurality of running wheels 13 and sprockets 28 and 29. The running wheels 13 each have a plurality of engagement grooves 13*a* engaged with the longitudinal racks 10 and are rotated and driven by a motor 14. The sprockets 28 and 29 are engaged with the lateral racks 10*a* and rotated and driven by a motor 17.

10 Claims, 7 Drawing Sheets

DRIVING APPARATUS FOR MOVING BODY

BACKGROUND OF THE INVENTION

1. Field of the Invention

The present invention relates to a mechanism for moving a running member on a track plate having a guide means in forward, rearward, leftward, and rightward directions.

2. Description of the Prior Art

A moving mechanism of a running member shown in FIG. 7 is known as a prior art. In this mechanism, a running member 2 is disposed on a track plate 1 having a plurality of guide grooves 1*a*.

The moving mechanism of the running member 2 comprises a drive wheel 4 and sprockets 6 and 6. The drive wheel 4 is rotated by a motor 3 that serves as a drive means through a reduction gear (not shown) so as to move the running member 2 in a forward direction (in which the guide grooves extend). The sprockets 6 and 6 are engaged with the guide grooves 1*a* on the track plate 1 so as to move the running member 2 in leftward and rightward directions.

The drive wheel 4 comprises two divided wheels 4*a* and 4*b*. Rubber belts 4*c* and 4*d* are disposed on the outer peripheries of the divided wheels 4*a* and 4*b*, respectively. The divided wheels 4*a* and 4*b* are pivoted by support shafts 7 and 7, respectively. Thus, the divided wheels 4*a* and 4*b* are slidable along the respective support shafts 7 and 7.

While the rubber belts 4*c* or 4*d* of the divided wheel 4*a* or 4*b* is in contact with the track plate 1, when the running member 2 is moved in the leftward or rightward direction by the rotations of the sprockets 6 and 6, the divided wheel 4*a* or 4*b* is moved in the rightward or leftward direction on the support shaft 7.

Thus, while the running member 2 is being moved in forward direction by the drive wheel 4, it can be moved in the leftward and rightward directions by the sprockets 6 and 6. Consequently, the running member 2 can be moved in an oblique direction.

An example of this type of mechanism is disclosed in Japanese Patent Laid-Open Publication No. Hei 2-92383.

[Problem to be solved by the Invention]

However, in such a conventional mechanism, the frictional coefficient between the track plate 1 and the rubber belts 4*c* and 4*d* lowers due to aged deterioration of the rubber belts 4*c* and 4*d*. In addition, since frictional force takes place between the sprockets 6 and 6 and the guide grooves 1*a* of the track plate 1 while the running member 2 is going in the oblique direction, the drive wheel 4 slips. Thus, the moving distance of the running member 2 does not accord with the rotation of the drive wheel 4. Thus, the accuracy of the moving distance is low.

In addition, when the running member 2 is moved in the oblique direction by the rotations of the sprockets 6 and 6, the divided wheel 4*a* or 4*b* of the drive wheel 4 is slidably moved to the right or left on the support shaft 7. Thus, a sliding resistance takes place between the divided wheel 4*a* or 4*b* and the support shaft 7. Consequently, when the running member 2 is moved in the oblique direction, a useless load caused by the frictional resistance is applied to the motor 5.

SUMMARY OF THE INVENTION

It is an object of the present invention to provide a mechanism for moving a running member in which the moving distance of drive wheels is caused to correspond to the rotation of the wheels and in which the moving resistance of the running member in an oblique direction is minimized.

It is another object of the present invention to provide a mechanism for moving a running member in which the running member is precisely moved to a desired position without need to employ a feedback control that uses a sensor or the like.

The present invention was made to attain the objects. A moving mechanism of a running member according to one aspect of the invention comprises a track plate and a running member adapted to run on the track plate. The track plate has a guide means. The guide means includes a plurality of longitudinal racks and a plurality of lateral racks that are crossed at right angles. The running member has a plurality of running wheels and a plurality of sprockets. The running wheels each have a plurality of engagement tooth portions engaged with the longitudinal racks and are rotated and driven by a drive means. The sprockets are engaged with the lateral racks and are rotated and driven by another drive means.

In the moving mechanism of a running member, the running wheels of the running member are disposed in an alignment direction of rack teeth of the longitudinal racks. The engagement tooth portions of the running wheels have barrel-shaped bearings rotatable in a direction perpendicular to the alignment direction of the rack teeth of the longitudinal racks. The running wheels are driven synchronously so that the barrel-shaped bearings of at least one of the running wheels are brought into contact with the track plate when the engagement tooth portions of another one of the running wheels are engaged with the racks.

In the moving mechanism of a running member, a running model is disposed above the running member. The running model is adapted to move corresponding to movement of the running member.

A moving mechanism of a running member according to another aspect of the invention comprises a track plate and a running member adapted to move on the track plate. The track plate has a guide means. The guide means includes a plurality of rack teeth with a predetermined length and disposed at equal pitches. The running member has a plurality of running wheels and a plurality of sprockets. The running wheels have a plurality of engagement tooth portions engaged with the rack teeth and are rotated and driven by a drive means. The running wheels are disposed in an alignment direction of the rack teeth. The sprockets are engaged with the rack teeth and are rotated and driven by a drive means. The engagement tooth portions of the running wheels have barrel-shaped bearings rotatable in a direction perpendicular to the alignment direction of the rack teeth. At least one of the barrel-shaped bearings is adapted to be rotated and brought into contact with the track plate when one of the engagement tooth portions is engaged with the rack teeth. The engagement tooth portions of another one of the running wheels are adapted to float from the rack teeth when the barrel-shaped bearing is in contact with the track plate.

In the moving mechanism of a running member, the sprockets are a set of front and rear sprockets synchronously rotated so as to move the running member in the rotating direction of the barrel-shaped bearings.

The moving mechanism of a running member further comprises a front drive means for driving the running wheels used for a front running module disposed on a front side of the running member, and a rear drive means for driving the running wheels used for a rear running module disposed on a rear side of the running member.

The moving mechanism of a running member further comprises a synchronizing means for synchronously rotating the front drive means and the rear drive means.

In the moving mechanism of a running member, the synchronizing means comprises a central arithmetic operation means for outputting synchronous signals with a same number of pulses to the front drive means and the rear drive means.

The moving mechanism of a running member further comprises a transmission gear portion for synchronously rotating the running wheels of the front and rear running modules.

A moving mechanism of a running member according to still another aspect of the invention comprises a track plate and a running member adapted to relatively move on the track plate. The track plate has a guide means. The guide means includes a plurality of rack teeth with a predetermined length and disposed at equal pitches. The running member has a plurality of running wheels. The running wheels have a plurality of engagement tooth portions engaged with the rack teeth and are rotated and driven by a drive means. The running wheels are disposed in an alignment direction of the rack teeth. The engagement tooth portions of the running wheels have barrel-shaped bearings rotatable in a direction perpendicular to the alignment direction of the rack teeth. At least one of the barrel-shaped bearings is adapted to be rotated and brought into contact with the track plate when one of the engagement tooth portions is engaged with the rack teeth.

[Operation]

According to the invention, when the running wheels are rotated while the engagement tooth portions of the running wheels are being engaged with the longitudinal racks, the running wheels do not get slipped. Thus, the moving distance of the running wheels accords with the rotations thereof.

Further, according to the invention, in addition to the above operation, when the running member is moved in the alignment direction of the longitudinal racks, at least one of the barrel-shaped bearings is in contact with the track plate, thereby supporting the running member. Thus, the moving resistance of the running wheels in the alignment direction of the lateral racks can be minimized.

Further, according to the invention, in addition to the above operations, the running model is moved for a distance precisely corresponding to the rotations of the running wheels. In addition, the running model is smoothly moved in the alignment direction of rack teeth of the lateral racks.

Further, according to the invention, while the barrel-shaped bearing of the running wheel is in contact with the track plate, the engagement tooth portion of another running wheel floats from the lateral racks. Thus, the moving resistance of the running wheels in the alignment direction of rack teeth of the longitudinal racks is a rotating resistance of the barrel-shaped bearings. Consequently, the running wheels can be moved in the oblique direction and the lateral direction with a smaller moving resistance than the sliding resistance that takes place between the drive wheels and the support shafts of the drive mechanism of the conventional running member.

Further, according to the invention, the sprockets are a set of sprockets that are synchronously rotated so as to move the running member in the rotating direction of the barrel-shaped bearings. Thus, the running member can be moved in parallel with the rotating direction of the barrel-shaped bearings.

Further, according to the invention, the running wheels are the front running module and the rear running module. The front running module is disposed at the front of the running member, whereas the rear running module is disposed at the rear of the running member. The running wheels have a front drive means and a rear drive means. The front drive means drives the running wheels disposed on the front running module. The rear drive means drives the running wheels disposed on the rear running module. Thus, the size of the motors and so forth of the running member can be reduced. Consequently, the size of the running member can be reduced.

Further, according to the invention, the synchronizing means causes the front drive means and the rear drive means to synchronously rotate. The running wheels driven by the front drive means and the running wheels driven by the rear drive means are synchronously rotated. Thus, the running member can be securely moved.

Further, according to the invention, the central arithmetic operation means outputs synchronous signals with the same number of pulses to the front drive means and the rear drive means. Thus, the running wheels driven by the front and rear drive means are synchronously rotated. Consequently, the running member can be securely moved.

Further, according to the invention, the transmission gear portion synchronously rotates the wheels of the front and rear drive modules. Thus, when the engagement tooth portion of one of the running wheels is engaged with the racks, a barrel-shaped bearing of another running wheel is securely in contact with the track plate.

Further, according to the invention, the running member is always supported by at least one of the barrel-shaped bearings. Thus, while the running member is being accurately moved in the alignment direction of the rack teeth of the longitudinal racks, it can be smoothly moved in the alignment direction of the rack teeth of the lateral racks.

DESCRIPTION OF THE PREFERRED EMBODIMENT

Figures 1, 1A:
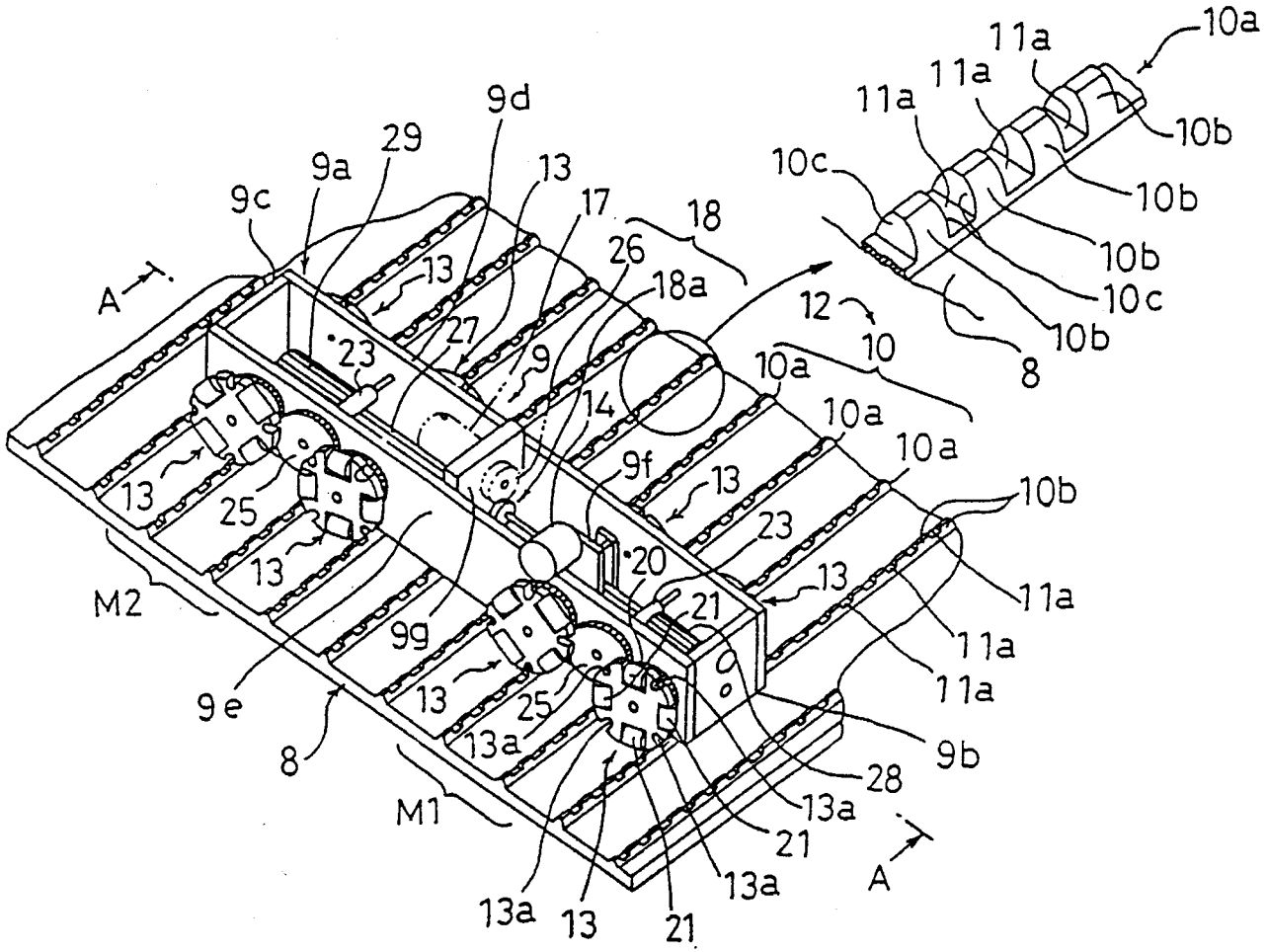
FIG. 1 is an overall perspective view showing that the running member according to an embodiment of the present invention is running on the track plate.
FIG. 1A is an enlarged view of a lateral rack of FIG. 1.

FIGS. 1 to 6 show an embodiment of the present invention.

First, the construction of the moving mechanism of a running member according to the embodiment will be described. The mechanism comprises a track plate 8 and a running member 9 that runs thereon.

A guide means 12 is formed on the track plate 8. The guide means 12 is constructed of a plurality of longitudinal racks 10 and a plurality of lateral racks 10*a*.

Each longitudinal rack 10 is constructed of a plurality of lateral racks 10*a* disposed at equal pitches in a main running direction of the running member 9. Each of the lateral racks 10*a* is constructed of a plurality of rack teeth 10*b* disposed at equal pitches in a lateral direction. Reference numeral 11*a* is an engagement groove defined between the rack teeth 10*b* and 10*b*. The height of the bottom surface of the engagement groove 11*a* is slightly larger than the height of the other portions of the track plate 8.

Side walls 10*c* of the rack teeth 10*b* of the lateral racks 10*a* are not always perpendicular to an alignment direction of the rack teeth 10*b*. For example, the side walls 10*c* may be defined in a curved shape similar to the tooth wall shape in the alignment direction of the lateral racks 10*a*. In other words, the side walls 10*c* may be defined in the tooth wall shape of an involute curve.

Next, the running member 9 will be described.

The running member 9 comprises a running member main body 9*a*, running wheels 13, a motor 14 (electric drive portion), a reduction gear portion 15, sprockets 28 and 29, a motor 17 (electric drive portion), and a reduction gear portion 18. The running wheels 13 are disposed on both sides of the running member main body 9*a*. The running wheels 13 are engaged with the longitudinal racks 10 so as to move the running member main body 9*a* in the alignment direction of the rack teeth of the longitudinal racks 10 (i.e., in the forward direction). The motor 14 and the reduction gear portion 15 construct a drive means of the drive wheels 13. The sprockets 28 and 29 are engaged with the lateral racks 10*a* so as to move the running member main body 9*a* in the alignment direction of the rack teeth of the lateral racks 10*a* (i.e., in the lateral direction). The motor 17 and the reduction gear portion 18 construct a drive means of the sprockets 28 and 29. The motors 14 and 17 are pulse motors.

The running member main body 9*a* is constructed of a front wall 9*b*, a rear wall 9*c*, a mounting member 9*g*, a left side wall 9*d*, and a right side wall 9*e*. The front wall 9*b*, the rear wall 9*c*, and the mounting member 9*g* are nipped by the left and right side walls 9*d* and 9*e* so that an outer frame with upper and lower open ends is formed.

A front running module M1 is disposed at a front half portion of the running member main body 9*a*. A rear running module M2 is disposed at a rear half portion of the running member main body 9*a*. The construction of the front running module M1 is almost the same as the construction of the rear running module M2.

Two rotating shafts 19 and 19 are disposed on both side walls 9*d* and 9*e* of each of the front and rear running modules M1 and M2. The two rotating shafts 19 and 19 extend from the side walls 9*d* and 9*e* and are spaced apart by a predetermined length. The running wheel 13 and a follower gear 20 are rotatably disposed on the rotating shaft 19. The follower gear 20 is secured to the running wheel 13.

A part of the front running module M1 is constructed of two pairs of the left and right running wheels 13 and the drive means.

A part of the rear running module M2 is constructed of two pairs of the left and right running wheels 13 and the drive means.

Figure 2:
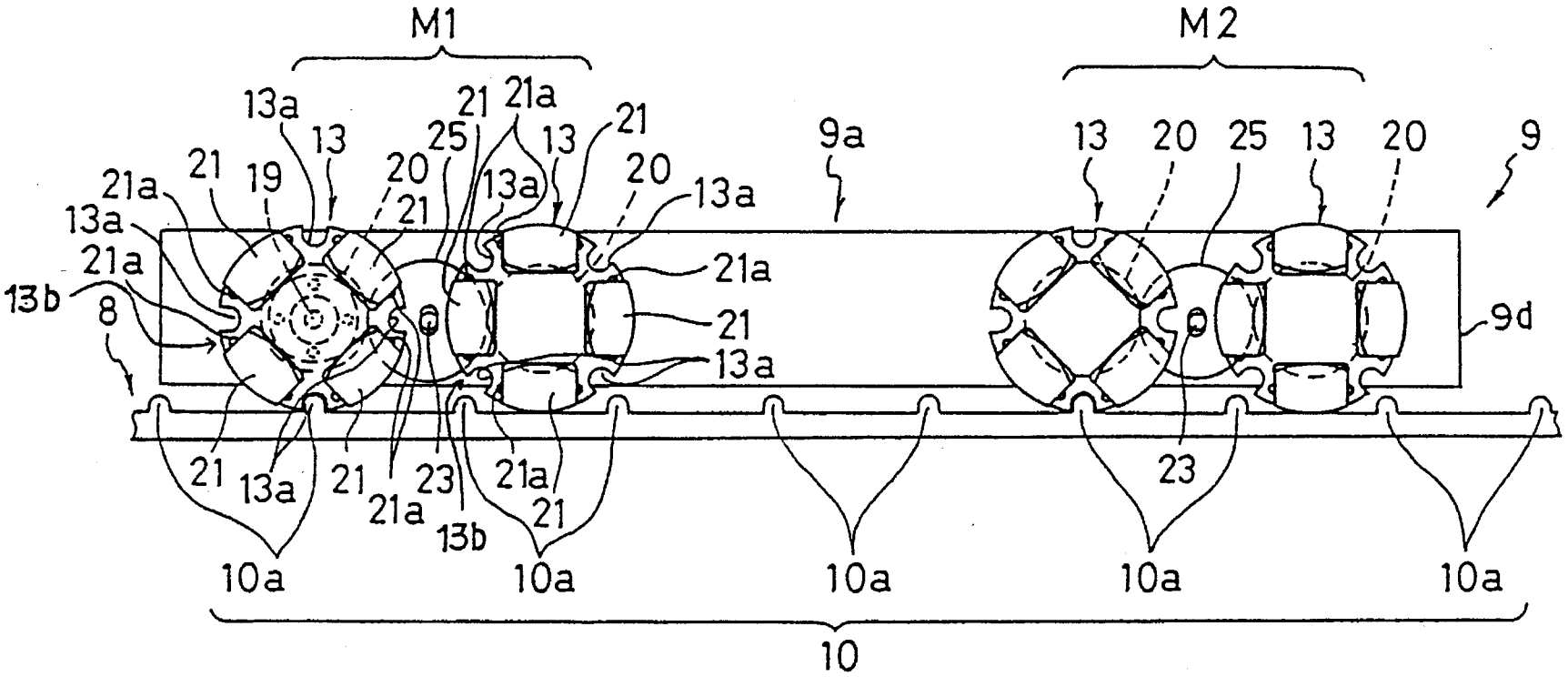
FIG. 2 is a side view of principal portions showing the relation of the track plate and running wheels according to the embodiment of the present invention.
Figure 3:
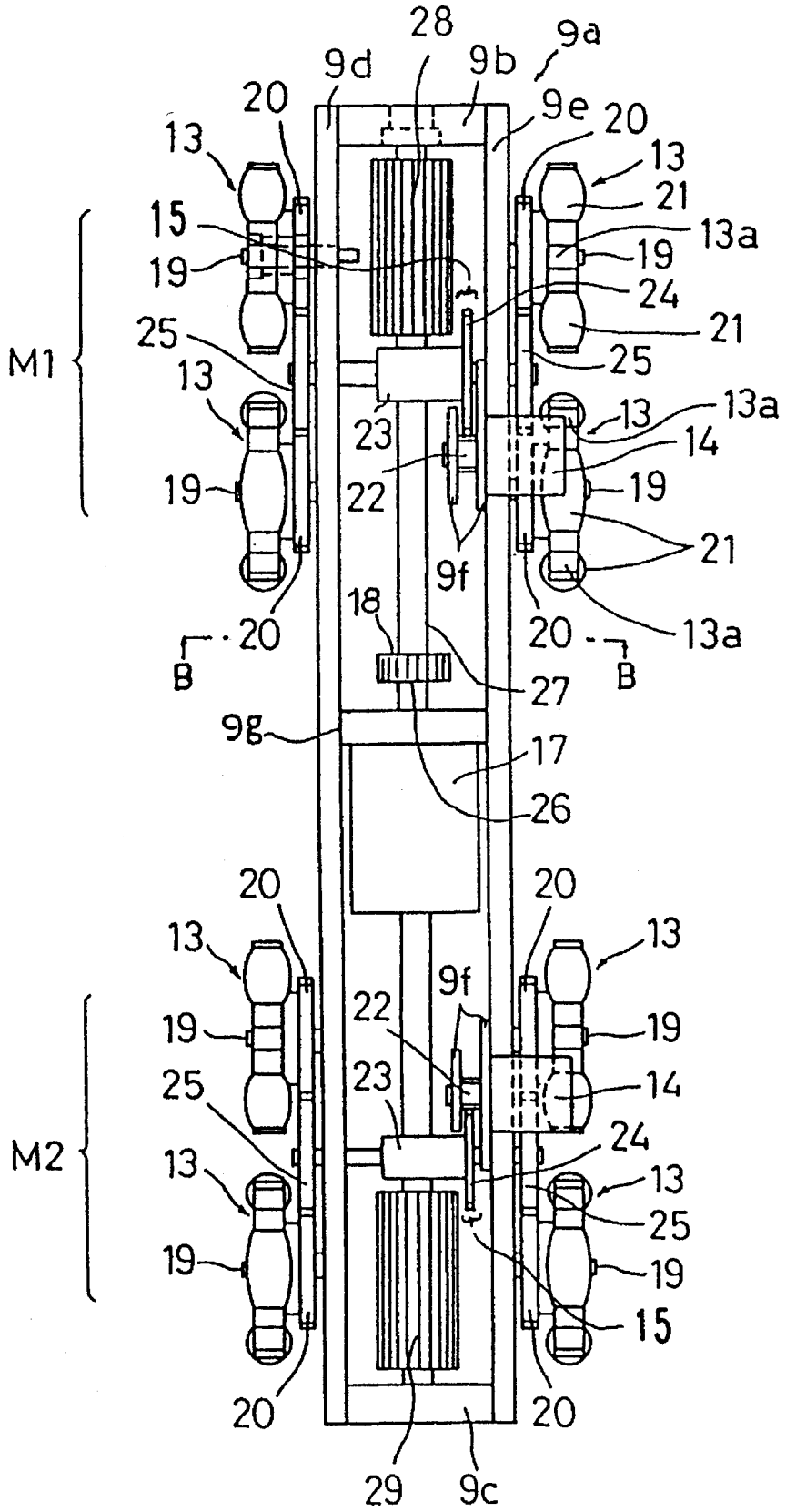
FIG. 3 is a top plan view showing the running member according to the embodiment of the present invention.

First of all, the front running module M1 will be described. As shown in FIGS. 1, 1A and 2, engagement grooves 13*a* are formed at pitches of 90° on peripheral portions of the left and right running wheels 13 and 13 of the front running module M1, thereby forming an engagement tooth portion 13*b*. The engagement grooves 13*a* are engaged with the engagement protrusions 10*a* on the track plate 8.

Barrel-shaped bearings 21 are disposed at the engagement tooth portion 13*b*. The barrel-shaped bearings 21 are rotated about respective pins 21*a* that extend in respective chord directions of the running wheel 13. The height of the outer periphery of the barrel shaped bearing 21 is slightly larger than the height of the periphery of the running wheel 13. The curvature of each barrel-shaped bearing 21 is nearly the same. The rotating direction of the barrel-shaped bearing 21 is perpendicular to the rotating direction of the running wheel 13.

Thus, while a barrel-shaped bearing 21 of one of the running wheels 13 is in contact with the track plate, the engagement groove 13*a* of another running wheel 13 floats from the surface of the racks.

The motor 14, which works as the drive means, is secured to the right side wall 9*e* through the mounting member 9*f*. A pinion gear 22 is disposed on a motor shaft of the motor 14. Within the reduction gear portion 15, pinion gear 22 is engaged with a reduction gear 24 that rotates and drives a drive shaft 23.

Follower gears 20 and 20 and a drive gear 25 are disposed at an end portion of the drive shaft 23. The follower gears 20 and 20 are engaged with the drive gear 25. Thus, the rotation of the drive shaft 23 is transmitted to the running wheel 13. As shown in FIG. 2, the follower gears 20 and 20 of each of the front and rear running modules M1 and M2 are engaged with the drive gear 25 in such a way that the phase of one follower gear 20 differs from the phase of the other follower gear 20 by 45°.

Thus, one set of the front and rear running wheels 13 and 13 of the front running module M1 are rotated and driven by the drive gears 25 so that when the engagement tooth portion 13*b* of one of the running wheels 13 is engaged with the longitudinal rack 10, one of the barrel-shaped bearings 21 of the other running wheel 13 is in contact with the track plate 8.

Figure 4:
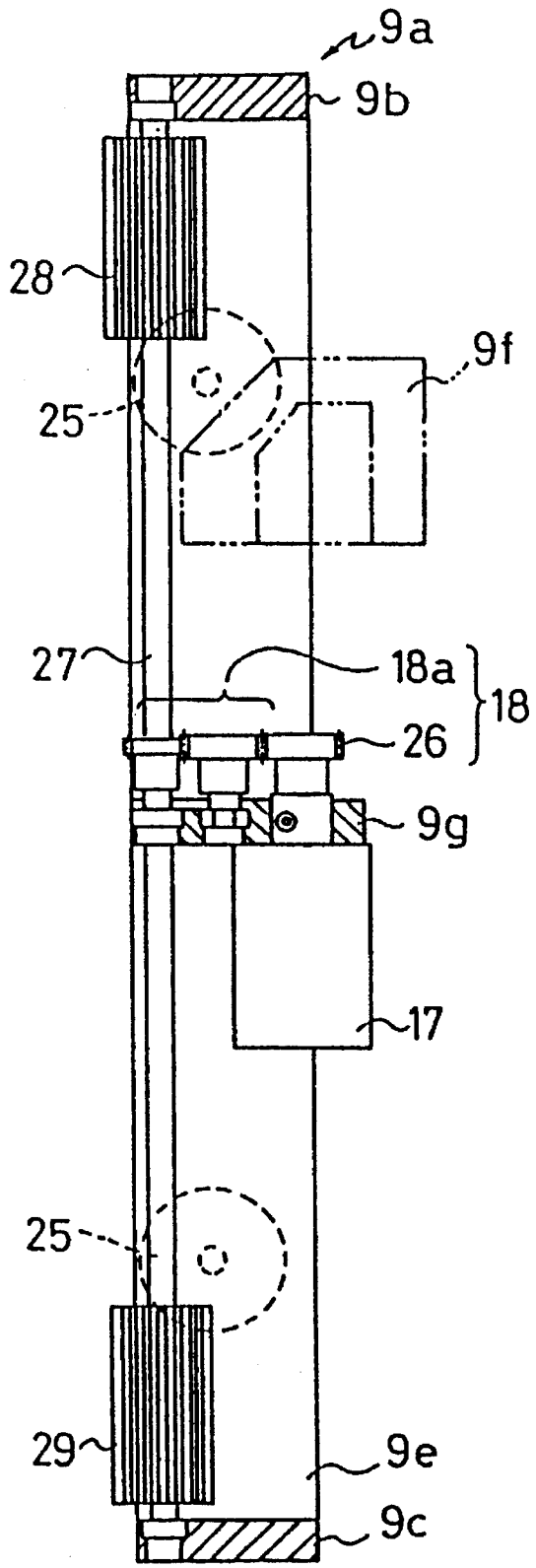
FIG. 4 is a sectional view, taken along line A—A of FIG. 1, showing a sprocket drive mechanism of the running member according to the embodiment of the present invention.
Figure 5:
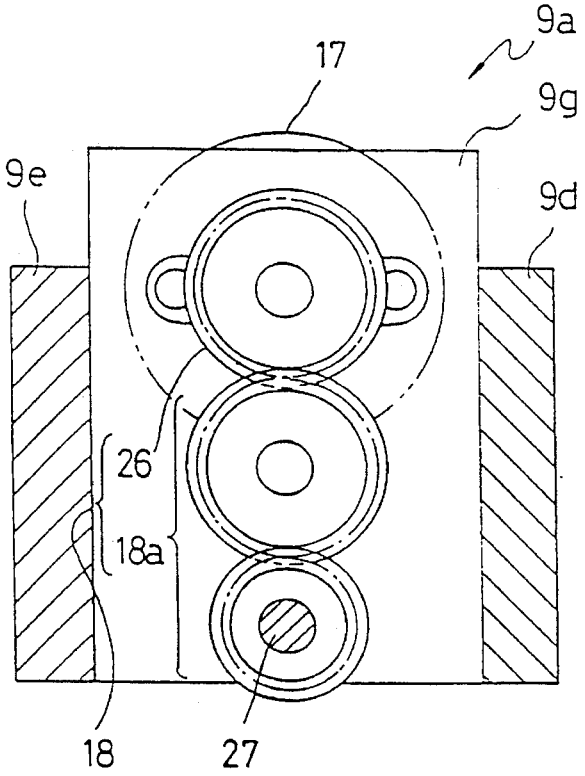
FIG. 5 is a sectional view, taken along line B—B of FIG. 3, showing a reduction gear portion of the running member according to the embodiment of the present invention.

In addition, as shown in FIG. 4, a motor case of the motor 17, which works as the drive means, is secured to the mounting member 9*g*. A pinion gear 26 is disposed on a motor shaft of the motor 17. The pinion gear 26 and a reduction gear train 18*a* construct the reduction gear portion 18. A rotating shaft 27 is disposed between the front and rear walls 9*b* and 9*c*. The rotating shaft 27 is rotatably pivoted between the front and rear walls 9*b* and 9*c*. The rotation of the pinion gear 26 is transmitted to the rotating shaft 27 through the reduction gear train 18*a*.

Sprockets 28 and 29 are disposed at front and rear end positions of the rotating shaft 27, respectively. The sprockets 28 and 29 are engaged with the lateral racks 10*a* on the track plate 8. Thus, as the rotating shaft 27 is rotated, the running member main body 9*a* is moved in the alignment direction of the rack teeth of the lateral racks 10*a*.

The lengths of the sprockets 28 and 29 are each slightly larger than the distance between the adjacent lateral racks 10*a* and 10*a*.

The rotations of the motors 14 and 17 are controlled by a power supply (not shown) and a central arithmetic operation means 111.

The construction of the rear running module M2 is nearly the same as the construction of the front running module M1. For simplicity, the same portions as those of the front running module M1 are denoted by the same reference numerals and a description of them is omitted (see FIGS. 1 to 3).

Next, the operation of the embodiment will be described.

When the motor 14 is driven, the front and rear running wheels 13 and 13 are rotated in the alignment direction of the rack teeth of the longitudinal racks 10 of the track plate 8.

Thus, the engagement grooves 13*a* and 13*a* of the front and rear running wheels 13 and 13 are engaged with the engagement protrusions 10*a* and 10*a* (i.e., the lateral racks), one by one, thereby moving the running member 9 in the forward direction.

Since one of the engagement grooves 13*a* and 13*a* is always engaged with one of the engagement protrusions 10*a* when moved, unlike the drive mechanism of the conventional running member, the running member 9 according to the present invention does not slip or skid. Thus, the running member 9 can be moved exactly corresponding to the rotations of the running wheels 13.

Figure 6:
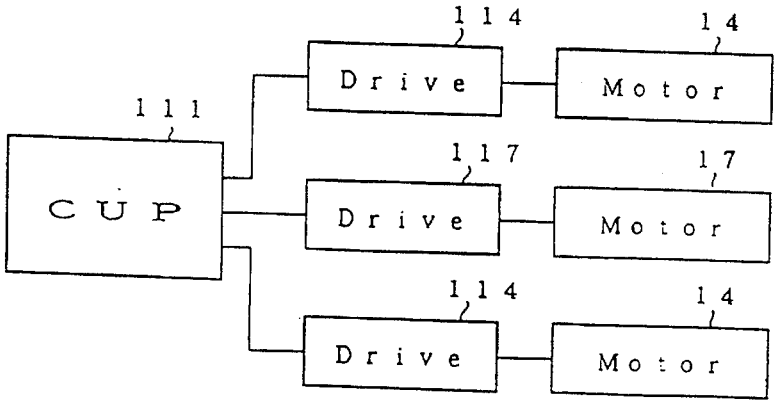
FIG. 6 is a block diagram showing a control portion of the running member according to the embodiment of the present invention.
Figure 7:
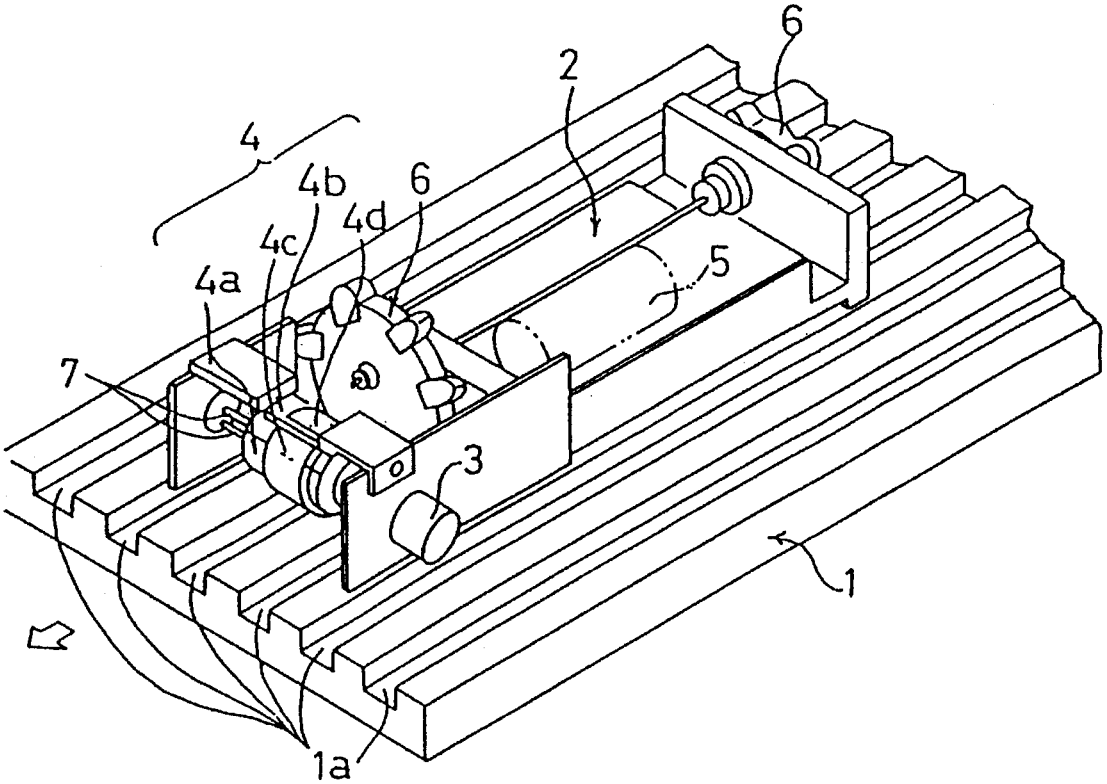
FIG. 7 PRIOR ART
FIG. 7 is an overall perspective view showing a conventional running member that is running on a track plate.

Consequently, when a stepping motor or the like is used for the motor 14, as shown in FIG. 6, the central arithmetic operation means (Central Processing Unit (CPU) 111 outputs drive signals to drive portions 114, 117, and 114.

The drive portions 114, 117, and 114 rotate and drive the motors 14, 17, and 14 corresponding to the received drive signals, respectively. Thus, the drive portions 114, 117, and 114 determine the rotations of the running wheels 13 corresponding to the number of pulses of the drive signals transmitted from the central arithmetic operation means 111, thereby controlling the moving distance of the running member 9. As a result, the running member 9 is precisely moved to a desired position. Consequently, unlike the prior art, since feedback control is not used in the present invention, sensors or the like that measure the moving distance of the running member 9 are not required.

In addition, since the drive signals with the same number of pulses are supplied to the drive portions 114 and 114 of the motors 14 and 14, the motors 14 and 14 synchronously rotate. Thus, even if the running modules M1 and M2 are spaced apart from each other, the running wheels thereof can be synchronously rotated. Consequently, since the size of the motors 14 and 14 and so forth can be reduced, the flexibility for mounting other devices can be improved.

Moreover, the central arithmetic operation means 111 causes the front drive means and the rear drive means to synchronously rotate. Thus, the running wheels 13 driven by the front drive means of the front running module M1 and the running wheels 13 driven by the rear drive means of the rear running module M2 are synchronously rotated, thereby exactly moving the running member 9.

When the motor 17 is driven, the sprockets 28 and 29 are rotated and driven through the pinion gear 26, the reduction gear portion 18*a*, and the rotating shaft 27.

Thus, the sprockets 28 and 29 cause the running member 9 to move in parallel with the rotating direction of the barrel-shaped bearings 21. Consequently, the running member main body 9*a* is moved in the alignment direction of the rack teeth of the lateral racks 10*a*.

At this time, while the running wheels 13 and 13 are being rotated, at least one of the barrel-shaped bearings 21 of the running wheels 13 of the front running module M1 and at least one of the barrel-shaped bearings 21 of the running wheels 13 of the rear running module M2 are in contact with the track plate 8, thereby supporting the running member 9. In addition, while the barrel-shaped bearing 21 of the running wheel 13 is in contact with the track plate 8, the engagement tooth portion 13*a* of the other running wheel 13 floats from the lateral racks 10*a*. Thus, the moving resistance of the running member 9, which runs in the alignment direction of the rack teeth of the longitudinal racks 10, corresponds to the rotating resistance of the barrel-shaped bearings 21. Consequently, the running member 9 can be moved in an oblique direction and a lateral direction with a lower moving resistance than a sliding resistance that takes place between drive wheels and support shafts of the drive mechanism of the conventional running member.

In the moving mechanism according to the embodiment, since the front and rear running modules M1 and M2 are driven by the front and rear drive means, respectively, the size of the motor 14 and so forth can reduced. Thus, the size of the running member 9 can be reduced.

In addition, when the engagement grooves 13*a* of one running wheel 13 are engaged with the lateral racks 10*a*, at least one of the barrel-shaped bearings 21 of the other running wheel 13 is synchronously in contact with the track plate 10.

In the moving mechanism of the running member according to the embodiment, the front and rear running modules M1 and M2 are disposed at front and rear of the running member main body 9*a*. However, the present invention is not limited to such a construction. Instead, one of the running modules M1 and M2 may be disposed on the running member main body 9*a*. In this construction, since at least one of the barrel-shaped bearings 21 of the running wheels 13 is in contact with the track plate 8, the running member 9 can be moved in the oblique and lateral directions with a low moving resistance like the construction where the two barrel-shaped bearings 21 and 21 are in contact with the track plate 8.

In the above embodiment, the central arithmetic operation means 111 that outputs synchronous signals with the same number of pulses is provided as the synchronizing means that synchronizes the rotations of the running wheels of the running modules M1 and M2. However, the present invention is not limited to such a construction. Instead, the synchronizing means may be constructed of a timing belt or the like so as to synchronize the rotations of the running wheels 13 of the running modules M1 and M2.

In addition, in the moving mechanism of the conventional running member, when the drive wheels are moved to the end portion of the support shaft and come in contact with the side wall of the running member, they are prohibited from being moved further in the leftward and rightward directions. Thus, the movement of the running member in the lateral direction is limited.

On the other hand, according to the above embodiment of the present invention, since the barrel-shaped bearings 21 are rotated in the alignment direction of the rack teeth of the lateral racks 10*a*, the running member 9 can be securely moved even only in the lateral direction without any restriction on the movement of the running member 9.

In the moving mechanism of the running member 9 according to the above embodiment, since the running member 9 can be smoothly moved in the lateral direction, the energy loss of the motor 17 can be minimized, thereby reducing the size and weight of the drive means.

Figure 8:
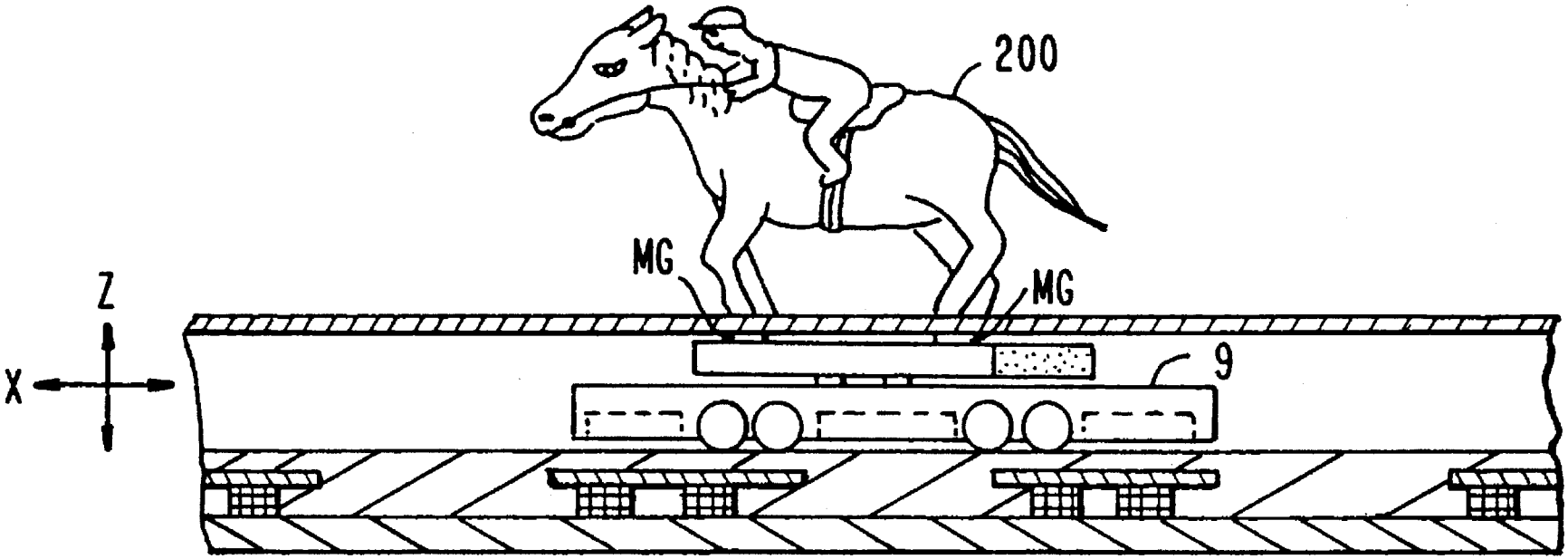
FIG. 8 shows an example of a running model for movement corresponding to that of the running member.

In addition, as shown in FIG. 8, model of a racing horse 200 is mounted on the track surface disposed above the running member 9. The horse model 200 and the running member 9 are attracted by magnetic force so that the horse model 200 is moved corresponding to the movement of the running member 9. Thus, the horse model 200 is smoothly moved in forward, backward, oblique, leftward and rightward directions on the track surface without restriction of the running path. Thus, actions similar to a real horse can be created.

In the moving mechanism of the running member according to the above embodiment, as the guide means of the track plate 8, the longitudinal racks 10 and the lateral racks 10*a* are formed of rack teeth 10*b*.

However, the present invention is not limited to such a construction. Instead, as long as a plurality of longitudinal racks and a plurality of lateral racks are crossed at right angles, any guide means may be used. For example, the longitudinal racks may be formed of guide grooves.

In this case, protrusion-shaped portions as the engagement tooth portions of the running wheels 13 should be used instead of the engagement grooves 13*a*.

In the above embodiment, the longitudinal racks 10 and the lateral racks 10*a* are crossed at right angles and the sprockets 28 and 29 are engaged with the lateral racks 10*a* to move the running member 9 in the alignment direction of the rack teeth of the lateral racks 10*a*. However, without the lateral racks 10*a*, the sprockets 28 and 29, and so forth, the running member 9 may be moved in the lateral direction by another moving means.

In this case, since the running member 9 is supported by the barrel-shaped bearings 13, the running member 9 can be precisely and smoothly moved in both the alignment direction of the rack teeth of the longitudinal racks 10 and the extension direction of the engagement protrusions 10*a* of the longitudinal racks 10. Thus, the present invention can be applied to any conveying means that should securely move a relative position of an object while moving it in the direction perpendicular to the moving direction.

[Effects of the Invention]

As described above, according to the present invention, while the engagement tooth portion of the running wheel is engaged with the longitudinal racks of the track plate, the running member is moved in the alignment direction of the rack teeth of the longitudinal racks. Thus, the running member can be moved exactly corresponding to the rotations of the running wheels. In addition, the motors that drive the running wheels can be prevented from being excessively loaded.

Since the rotations of the running wheels can be pre-controlled by the drive means, the running member can be precisely moved to a desired position. In addition, according to the construction of the present invention, a plurality of running members can be disposed on the track plate so that the running members are moved independently of each other.

When the running member is moved in the alignment direction of the rack teeth of the lateral racks, at least one of the barrel-shaped bearings is in contact with the track plate and supports the running member. Thus, the running member can be moved in the oblique and lateral directions. Consequently, the energy loss of the drive means can be minimized. In addition, the size and weight of the drive means can be reduced.

When the running member is followed by the running model 200, the running model 200 is smoothly moved for a predetermined distance in forward, backward, oblique, leftward and rightward directions so that it securely arrives at a desired position. Thus, actions similar to a real horse can be created.

In addition, since the running member is supported by the barrel-shaped bearings and the engagement tooth portion floats from the rack teeth, the moving member can be moved in the alignment direction of the rack teeth of the lateral racks while it is accurately moved in the alignment direction of the rack teeth of the longitudinal direction. Thus, the present invention can be applied to any conveying means that should accurately move a relative position of an object while moving the object in the direction perpendicular to the moving direction with a moving resistance.

What is claimed is:

1. A mechanism for moving a running member, comprising:

a track plate;

a running member adapted to run on said track plate; and guide means, formed on said track plate, including a plurality of lateral racks, each of the lateral racks having a plurality of rack teeth disposed at equal pitches in a lateral direction, the lateral racks being disposed at equal pitches in a main running direction of the running member to form a longitudinal rack;

wherein said running member has a plurality of running wheels and a plurality of sprockets, the running wheels being rotated and driven by drive means and each having a plurality of engagement tooth portions engaged with the longitudinal racks, the sprockets being engaged with the lateral racks and rotated and driven by drive means.

2. A mechanism for moving a running member as set forth in claim 1, wherein the running wheels of said running member are arranged in a longitudinal direction of the longitudinal rack, the running wheels each having barrel-shaped bearings provided between the engagement tooth portions of the running wheels and being freely rotatable in a direction in which the lateral racks are elongated, the running wheels being driven synchronously so that, when the engagement tooth portions of one of the running wheels gear with the rack teeth of the longitudinal rack, the barrel-shaped bearings of at least one of the other running wheels are brought into contact with said track plate.

3. A mechanism for moving a running member as set forth in claim 2, further comprising a transmission gear portion for synchronously rotating the running wheels of the front and rear running modules.

4. A mechanism for moving a running member as set forth in claim 1, wherein a running model is disposed above said running member, the running model being coupled to the running member to move corresponding to movement of said running member.

5. A mechanism for moving a running member as set forth in claim 1, wherein the sprockets are a set of front and rear sprockets synchronously rotated so as to move said running member in a direction in which the lateral racks are elongated.

6. A mechanism for moving a running member as set forth in claim 1, further comprising:

front drive means for driving the running wheels used for a front running module disposed on a front side of said running member; and rear drive means for driving the running wheels used for a rear running module disposed on a rear side of said running member.

7. A mechanism for moving a running member as set forth in claim 6, further comprising synchronizing means for synchronously rotating the front drive means and the rear drive means.

8. A mechanism for moving a running member as set forth in claim 7, wherein said synchronizing means comprises central arithmetic operation means for outputting synchronous signals with a same number of pulses to the front drive means and the rear drive means.

9. A mechanism for moving a running member, comprising:

a track plate having guide means wherein a plurality of rack teeth with a predetermined length are disposed at equal pitches; and a running member adapted to relatively move on said track plate;

wherein said running member has a plurality of running wheels and a plurality of sprockets, the running wheels having a plurality of engagement tooth portions engaged with said rack teeth and are rotated and driven by drive means, the running wheels being disposed in an alignment direction of said rack teeth, the sprockets being engaged with said rack teeth and are rotated and driven by drive means, the running wheels each having barrel-shaped bearings provided between the engagement tooth portions of the running wheels and being rotatable in a direction in which the lateral racks are elongated, at least one of the barrel-shaped bearings of the running wheels being rotated synchronously with the engagement tooth portions so as to be brought into contact with said track plate when one of the engagement tooth portions gears with said rack teeth, the one of the engagement tooth portions being adapted to float from said rack teeth when the barrel-shaped bearing is in contact with said track plate.

10. A mechanism for moving a running member, comprising:

a track plate having guide means, the guide means including a plurality of rack teeth with a predetermined length and disposed at equal pitches; and a running member adapted to relatively move on said track plate;

wherein said running member has a plurality of running wheels, the running wheels having a plurality of engagement tooth portions engaged with the rack teeth and are rotated and driven by drive means, the running wheels being disposed in an alignment direction of the rack teeth, the running wheels each having barrel-shaped bearings provided between the engagement tooth portions and being rotatable in a direction in which the lateral racks are elongated, at least one of the barrel-shaped bearings being adapted to be rotated and brought into contact with said track plate when one of the engagement tooth portions is engaged with the rack teeth.

* * * * *